US006800006B1

(12) United States Patent
Itnyre et al.

(10) Patent No.: US 6,800,006 B1
(45) Date of Patent: Oct. 5, 2004

(54) SURFBOARD CONSTRUCTION HAVING A HOLLOW COMPOSITE BODY

(75) Inventors: Mark T. Itnyre, Laguna Beach, CA (US); Michael L. Halun, Baton Rouge, LA (US); Peter M. Mehiel, Danville, CA (US)

(73) Assignee: Hydro-Epoch, Inc., Laguna Beach, CA (US)

( * ) Notice: Subject to any disclaimer, the term of this patent is extended or adjusted under 35 U.S.C. 154(b) by 0 days.

(21) Appl. No.: 10/283,018

(22) Filed: Oct. 29, 2002

(51) Int. Cl.[7] ..... B63B 35/79
(52) U.S. Cl. ..... 441/74; 114/357
(58) Field of Search ..... 114/357; 441/65, 441/74

(56) References Cited

U.S. PATENT DOCUMENTS

| | | | | | |
|---|---|---|---|---|---|
| 1,830,015 | A | * | 11/1931 | Carmichael | 441/74 |
| 1,872,230 | A | * | 8/1932 | Blake | 441/74 |
| 2,389,729 | A | * | 11/1945 | Howland | 441/74 |
| 3,414,919 | A | * | 12/1968 | Gust | 441/74 |
| 3,514,798 | A | * | 6/1970 | Ellis | 441/74 |
| 4,276,844 | A | * | 7/1981 | Fremont | 114/39.14 |
| 4,531,922 | A | * | 7/1985 | Schutz | 441/74 |
| 5,266,249 | A | | 11/1993 | Grimes, III et al. | 264/45 |
| 5,514,017 | A | | 5/1996 | Chimiak | 441/65 |

OTHER PUBLICATIONS

Website of Surftech Technology/Tuflites.

* cited by examiner

*Primary Examiner*—Stephen Avila
(74) *Attorney, Agent, or Firm*—Edgar W. Averill, Jr.

(57) ABSTRACT

A surfboard having composite covered honeycomb deck and bottom surfaces. The surfboard has a hollow inner volume which contains a longitudinally oriented stringer. The stringer is spaced both from the nose of the surfboard and from the tail of the surfboard so that the nose and tail are more flexible than the length containing the stringer. The process of making the board is also disclosed.

19 Claims, 3 Drawing Sheets

FIG. 1
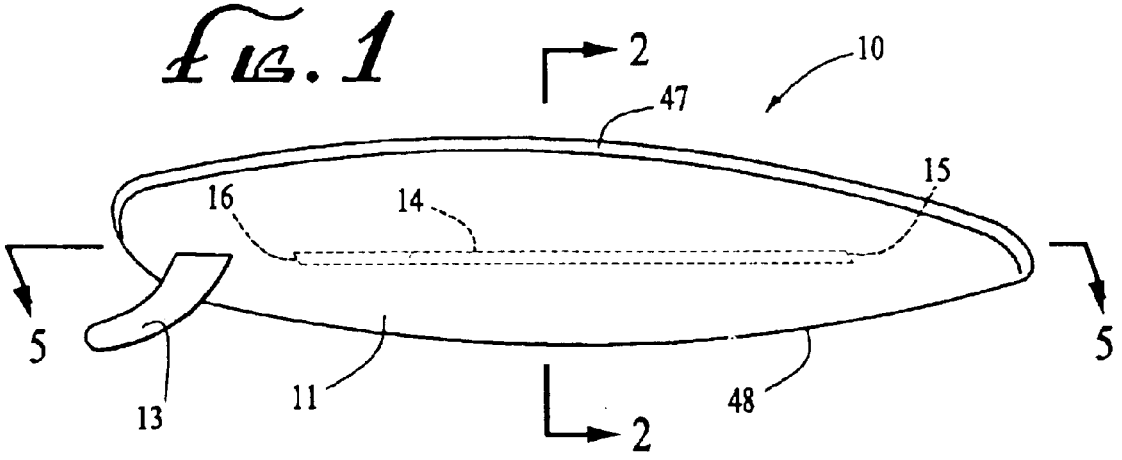
FIG. 2
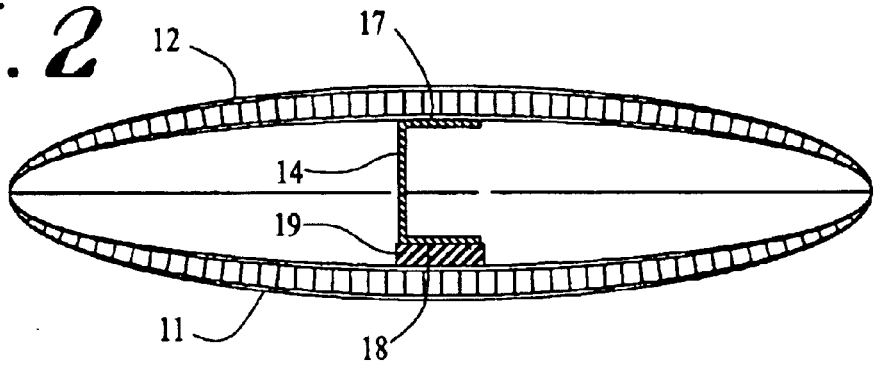
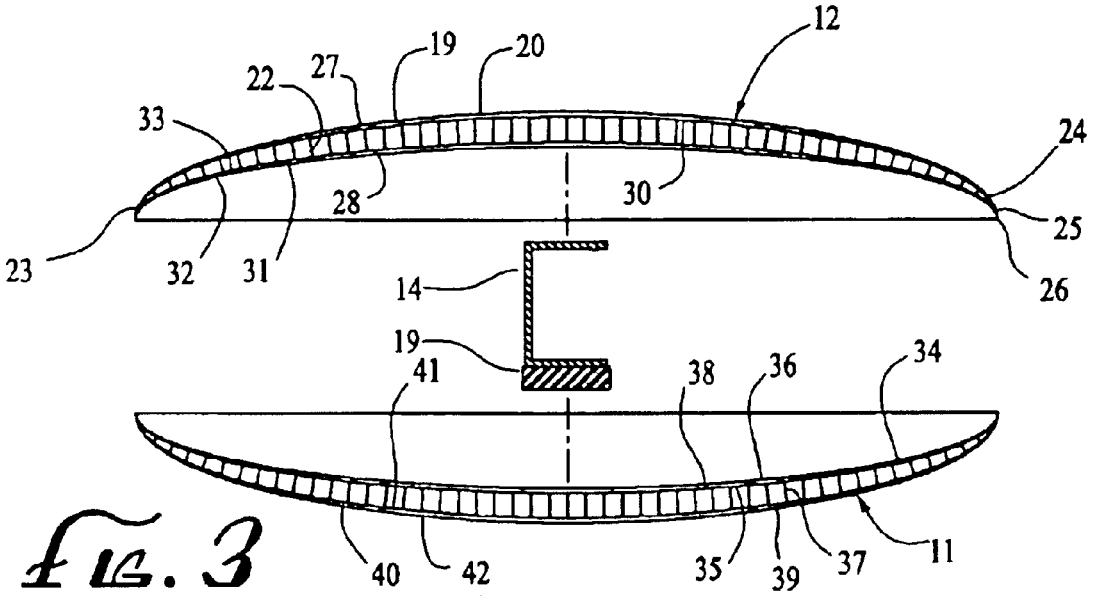
FIG. 3

SURFBOARD CONSTRUCTION HAVING A HOLLOW COMPOSITE BODY

BACKGROUND OF THE INVENTION

The field of the invention is broadly sporting goods and more particularly to water borne sporting goods, such as surfboards, wind surfers, wake boards and sailboats.

Typically, surfboards are made utilizing a urethane foam core. The foam core is shaped to the desired shape. The core is then covered with a composite material which is cured, smoothed and polished.

Various alternative designs have been proposed and used. A recreational board having a honeycomb core is shown in U.S. Pat. No 5,514,017. The honeycomb core is surrounded by a fiberglass scrim and with a second laminating layer.

Another recreational board is shown in U.S. Pat. No. 5,266,249. This board is formed by placing honeycomb core laminates in a mold and placing a vacuum bag inside the hollow structure. The vacuum bag pulls the honeycomb core laminate against the mold while it is cured. The vacuum bag is then removed through a hole in the hollow member. The hollow member has an inner support wall, which also has a honeycomb core surrounded by composite material layers.

An expanded polystyrene filled board is commercially available under the trademark "Tuflites." The expanded polystyrene blank of this board is formed in a mold. The blank is then surrounded by a sandwiched laminate containing a PVC sheet foam.

While the present invention is useful for a number of recreational boards, such as wind surfers and wake surfing boards, it is known to be more challenging to make a surfboard, since a surfboard must flex a desired amount and in desired locations. In the present foam shaping process, the foam core is shaped to create the desired flexibility. To date, no other board forming process has resulted in the desired flexibility present in conventionally shaped boards.

BRIEF SUMMARY OF THE INVENTION

It is an object of the present invention to make a hollow surfboard which will flex in an amount and at locations desired by surfers.

The present invention is for a surf board having a deck and a bottom. In one aspect, an embodiment has a deck fabricated from a laminate having an outer composite layer, an intermediate core fabricated from a honeycomb material, and an inner composite layer under the honeycomb material. The deck portion is joined to a bottom portion also fabricated from a laminate having an outer composite layer, a honeycomb inner core, and a bottom composite layer. A stringer comprising an elongated member is adhered to the inner surfaces of the deck and bottom. The core does not extend either to a nose or a tail of the surfboard so that the nose and tail are more flexible than that portion of the surfboard containing the elongated stringer. In another aspect, the stringer has a layer of urethane foam between its lower surface and the inner surface of the bottom to provide a degree of flexibility. Preferably, the stringer is about half the length of the surfboard and is positioned longitudinally and closer to the tail than to the nose.

The present invention also is for the process of forming the above-described surfboard. The process includes the steps of forming a first layer of honeycomb core into the shape of a deck of a surfboard. The core is covered top and bottom with resin and fiber, which extends past the outer peripheral edge of the honeycomb core. This deck laminate is placed on a shaped concave deck mold and surrounded with a vacuum bag. The vacuum bag pulls the laminate against the mold after which it is heated and the laminate cured. The bottom is formed utilizing the same steps. After curing, a stringer is adhered longitudinally to the inner surface of the deck or bottom. Next, an adhesive composition is placed on the exposed side of the stringer and the deck and bottom pieces are joined around the outer flaps thereof and cured to form the assembly into a hollow surfboard having a longitudinal stringer. Preferably, the adhesive composition which is placed on the stringer after it has been adhered to one of the surfaces, is a urethane prefoam which rises and forms a bond between the stringer and the inner surface of the board half to which it is adhered.

BRIEF DESCRIPTION OF THE DRAWINGS

FIG. 1 is a perspective view showing the underside of the surfboard of the present invention.

FIG. 2 is cross-sectional view taken along line 2—2 of FIG. 1.

FIG. 3 is an exploded perspective view thereof.

DETAILED DESCRIPTION OF THE INVENTION

Figure 4:
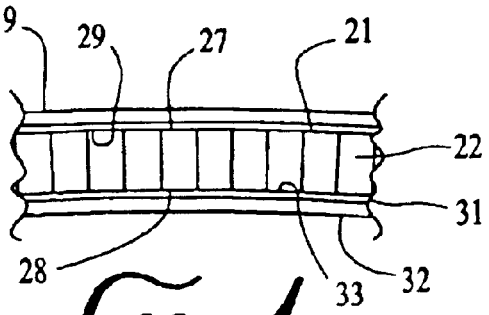
FIG. 4 is an enlarged cross-sectional view of a portion of the deck of the surfboard of FIG. 1.

A surfboard of the present invention is shown in perspective view in FIG. 1 and indicated generally by reference character 10. Surfboard 10 has a bottom 11, a deck 12, and a fin 13. The fin itself is conventional and typically more than one fin is used.

A stringer 14 is shown in phantom view in FIG. 1 and has a forward end 15 and a rear end 16. Stringer 14 is shown in cross-sectional view in FIG. 2 and is of a C-shape having an upper surface 17 and a lower surface 18. Upper surface 17 is glued to the deck undersurface. The lower surface 18 is adhered to the bottom inner surface, preferably through a layer of urethane foam 19.

As shown in FIG. 3, the deck and bottom are formed separately after which the stringer is adhered to either the inner surface of the deck or the inner surface of the bottom. After the deck and bottom are joined, the other surface of the stringer is adhered to the other inner surface by the extension of a prefoam.

Deck 12 has an outer composite layer 19' having an outer upper surface 20 which is formed from a composite material utilizing a resin, such as an epoxy resin, and fibers such as carbon fibers, Kevlar, S-glass, aramid fibers, or fiberglass, or a combination thereof. In one embodiment, as shown in FIG. 4, a thin epoxy carbon layer 21 is adhered to the upper surface of the deck intermediate core 22. Core 22 is a honeycomb material having a thickness of about ⅜". Alternate thicknesses can be employed within the scope of the present invention. Honeycomb core 22 is formed so that its outer peripheral edges 23 and 24, leaving an extending deck flap 25. Honeycomb is one type of core structure, but other materials of light weight and high structural strength may be used. The deck before joining has a deck peripheral edge 26.

Core 22 has an upper surface 27 and a lower surface 28. The outer composite layer 19' has an inwardly facing surface 29, which as shown in FIG. 4, is the lower surface of a composite such as a thin epoxy carbon layer 21. Under the lower surface 28 of the deck intermediate honeycomb core 22, is adhered to deck inner composite layer 31. Layer 31 has a lower inwardly facing surface 32 and an upper surface 33.

The bottom 11 similarly has an inner composite layer 34, having a lower surface 35 and an upper inwardly facing surface 36. The bottom intermediate core 37 has an upper core surface 38 adhered to the lower surface 35 of inner composite layer 34. Bottom intermediate core 37 has a lower core surface 39 which is adhered to an outer composite layer 40. Outer composite layer 40 has an inwardly facing surface 41 and an outer bottom surface 42.

Figure 5:
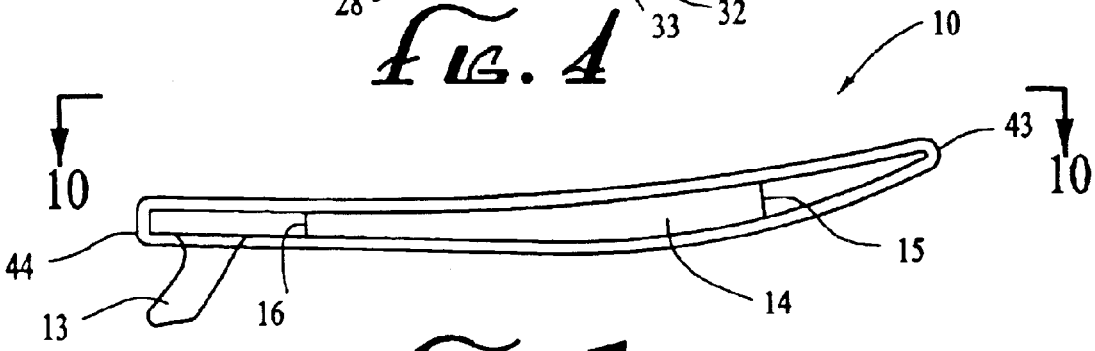
FIG. 5 is a cross-sectional view taken along line 5—5 of FIG. 1.

The board is shown in cross-sectional side view in FIG. 5. The length, placement, shape, and overall configuration of stringer 14 provides an immense potential for control of the finished board flexibility. For instance, the distance between forward end 15 of stringer 14 and nose 43 affects the flexibility of the nose portion of the board. The larger this space, the more the nose will flex. Similarly, the distance between rear end 16 and tail 44 affects the flexibility of the tail.

The thickness of the stringer 14 also affects the flexibility of the stringer, and thus, the finished board. The choice of fabric also affects the flexibility and carbon fibers provide a stiffer stringer than does E-glass or Kevlar. Those of skill in the art will readily adapt aa myriad of combinations of stringer length, thickness, or outer fabric within the scope of the present invention.

As also seen in FIG. 5, stringer 14 may be tapered to fit the inner shape of the hollow board 10.

While a single stringer is shown in FIGS. 1–5, a pair of stringers 45 and 46 may be used to provide stiffer rails. The rails are indicated by reference characters 47 and 48. More than two stringers may be used in alternate embodiments.

Figure 7:
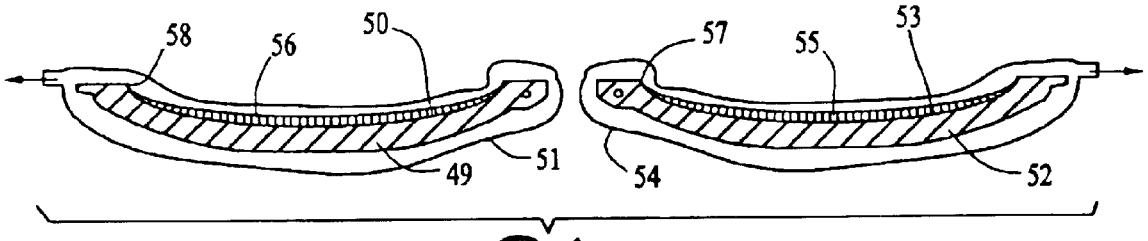
FIG. 7 is a cross-sectional end view of a deck and a bottom mold used in the process of the present invention.
Figure 8:
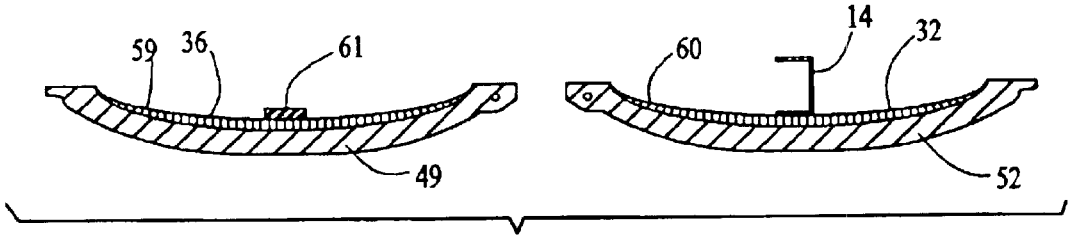
FIG. 8 is a cross-sectional view analogous to FIG. 7 showing the deck and bottom pieces in a cured state in their respective mold halves.
Figure 9:
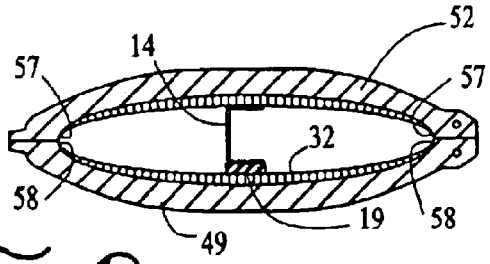
FIG. 9 is a cross-sectional view of the mold halves of FIG. 8 in a closed configuration.

A process of forming the board of the present invention is illustrated in FIGS. 7, 8, and 9. A shaped concave bottom mold 49 has an inner mold surface 50. An uncured bottom portion, including an aluminum honeycomb core and two uncured composite layers, is surrounded by a vacuum bag 51. A vacuum is drawn on vacuum bag 51, which pulls the sandwiched uncured bottom against the inner mold surface 50.

Similarly, shaped concave deck mold 52 has an inner mold surface 53 upon which a sandwiched aluminum honeycomb core surrounded by upper and lower composite layers is placed. A vacuum bag 54 surrounds the uncured deck 55. Both the uncured deck 55 and the uncured bottom 56 are formed with outer peripheral flaps 57 and 58, respectively. Once a vacuum is placed on vacuum bag 54, the deck portion can be cured and the vacuum bags removed.

As shown in FIG. 8, the cured bottom 59 and the cured deck 60 have their inner surfaces exposed. Stringer 14 can be adhered to the lower inwardly facing surface 32 of cured deck 60. Just before joining the deck and bottom halves, a polyurethane pre-foam strip 61 is placed on the upper inwardly facing surface 36 of bottom 59. Before it rises completely, the bottom mold and deck mold are joined as shown in FIG. 9. After joining, the polyurethane pre-foam strip 61 completes rising and forms a bond between the lower surface 18 of stringer 14 and the upper inwardly facing surface 36. This area between the stringer 14 and the surface 32 is referred to as a contact area where the stringer 14 is adhered to the deck piece. The outer peripheral flaps 57 and 58 are joined with an epoxy or other appropriate adhesive. The assembly of FIG. 9 is cured, the mold has separated and the finished product appropriately finished. In place of the urethane prefoam, other adhesives may be used.

Figure 10:
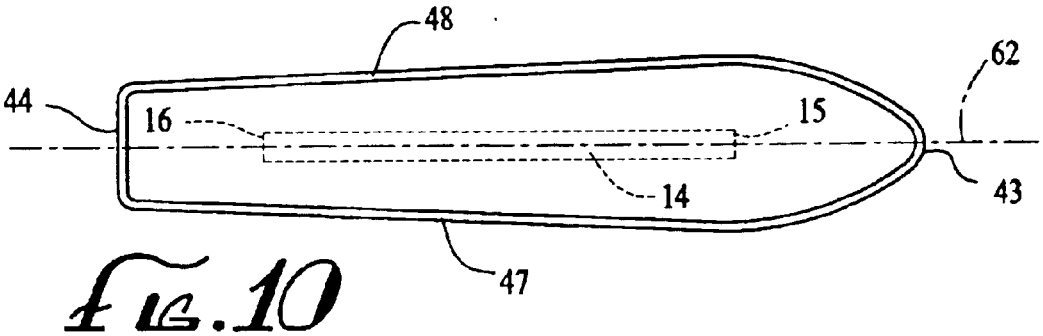
FIG. 10 is a cross-sectional view showing the inner surface of the bottom and the stringer.

A cross-sectional view showing the bottom of surfboard 10 is shown in FIG. 10. Surfboard 10 has a longitudinal axis 62 along which stringer 14 is aligned. For a surfboard having a 9'1" length, a stringer having a length of 4' has been found to provide an appropriate amount of flexibility. In this embodiment, prototypes having a space of 3⅓' between forward end 15 and nose 43 and a space of 1⅔' between rear end 16 and tail 44, utilizing a 4' stringer has proved a very satisfactory board. Of course, it is to be understood that the length of stringer 14 is variable, depending upon the requirement of the end user.

Figure 11:
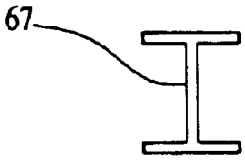
FIG. 11 is a cross-sectional view of an alternate embodiment of the stringer of FIG. 10.
Figure 12:
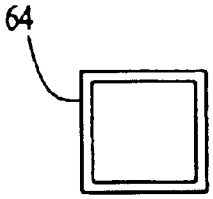
FIG. 12 is a cross-sectional view of an alternate embodiment of the stringer of FIG. 10.

While a C-shaped stringer has been shown in the drawings, other shapes of stringers are also contemplated. An I-beam shaped stringer is shown in FIG. 11 and a rectangular stringer 64 is shown in FIG. 12.

The end product is a surfboard of far less weight than conventional urethane foam cored surfboards. For instance, while a conventional board 9' long would weigh between 18–20 pounds, the same length of board made by the process of the present invention would weigh less than 10 pounds. The nature of the invention is that it yields a surfboard which can weigh less than half that of conventional surfboards which is many times stronger and more durable. The reduction in weight allows the surfer to maneuver the board with proportionally less effort. This provides far greater handling less inertia in movement on a wave.

Figure 13:
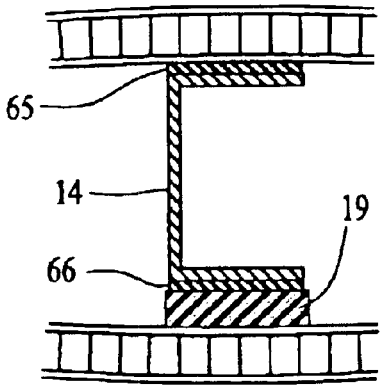
FIG. 13 is a cross-sectional view of an alternate embodiment of a stringer of the surfboard of FIG. 1.
Figure 6:
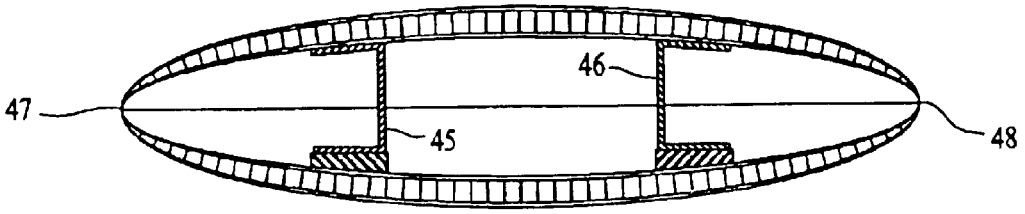
FIG. 6 is a cross-sectional view analogous to FIG. 2, except showing a pair of stringers.

As shown in FIG. 13, vibration dampening layers 65 and 66 have been added on the upper and lower surfaces of stringer 14 to deaden vibration.

While the construction of a surfboard has been emphasized above, it is, of course, to be understood that the construction can be used for any hollow water supported object, such as wind surfers, wake surfers, kite surfing, wake boards, or sail boats. In these applications, the same combination of light weight, strength, and variable flexibility are very useful.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A surfboard having a deck and a bottom, a nose and a tail, and a surfboard length, said surfboard comprising:

a deck fabricated from a laminate having outer and inner composite layers surrounding a deck intermediate core fabricated from a honeycomb material, said deck having a peripheral edge;

a bottom fabricated from a laminate having an outer and inner composite layers surrounding a bottom intermediate core fabricated from a honeycomb material, and said bottom having a bottom peripheral edge, said deck peripheral edge being sealed to said bottom peripheral edge to form a closed hollow structure; and a stringer comprising an elongated member having an upper stringer surface and a lower stringer surface, a forward end and a rear end, and a stringer length, said stringer being contained within said closed hollow structure and the upper stringer surface being adhered to said deck by an upper adhesive composition and said lower stringer surface being adhered to said bottom by a lower adhesive composition and at least one of said upper adhesive composition and said lower adhesive composition including a layer of foam.

2. The surfboard of claim 1 wherein said layer of foam is located in said lower adhesive composition.

3. The surfboard of claim 1 wherein forward end of said stringer is spaced from said nose and the rear end of said stringer is spaced from said tail.

4. The surfboard of claim 3 wherein said stringer length is about one half of said surfboard length.

5. The surfboard of claim 4 wherein said stringer is positioned closer to the rear of said surfboard than to the nose thereof.

6. The surfboard of claim 5 wherein the distance between the forward end of said stringer and the nose of the surfboard is about twice the distance between the rear end of said stringer and the tail of the surfboard.

7. The surfboard of claim 1 wherein said stringer has a C-shaped cross sectional shape.

8. The surfboard of claim 1 wherein said layer of foam is about one quarter of an inch thick.

9. The surfboard of claim 1 wherein said layer of foam is a polyurethane foam.

10. The surfboard of claim 1 wherein said stringer is fabricated from a composite of resin and fibers.

11. The surfboard of claim 1 wherein at least one of said upper and lower adhesive compositions includes a vibration dampening layer.

12. A surfboard comprising:

a deck fabricated from an upper honeycomb core sandwiched between upper and lower composite layers and said upper deck having a deck peripheral edge;

a bottom fabricated from a lower honeycomb core sandwiched between upper and lower composite layers and said bottom having a bottom peripheral edge joined to said deck peripheral edge to form a surfboard shell having a hollow interior volume and having a nose and a tail and a surfboard length between the nose and tail; and an elongated stringer located within said hollow interior volume, said stringer having an upper surface, a lower surface, a forward end, a rear end, and a length and said stringer being adhered to said deck and bottom along its upper and lower surfaces respectively, and said forward end of said stringer being spaced from the nose of the surfboard and the rear end of said stringer being spaced from the tail of said surfboard.

13. The surfboard of claim 12 wherein the length of the stringer is about one half that of the surfboard length.

14. The surfboard of claim 12 wherein said stringer has a C-shaped cross sectional shape and is fabricated from a composite material.

15. The surfboard of claim 12 wherein said stringer is a first stringer and further including a second stringer located within said hollow interior volume, said second stringer having an upper surface, a lower surface, a forward end, a rear end, and a length and said second stringer being adhered to said deck and bottom along its upper and lower surfaces respectively, and said forward end of said second stringer being spaced from the nose of the surfboard and the rear end of said second stringer being spaced from the tail of said surfboard and said surfboard having a longitudinal axis and said first and second stringers being parallel to one another and equally spaced from said longitudinal axis.

16. The surfboard of claim 12 wherein said honeycomb cores are fabricated from aluminum.

17. A process for forming a hollow surfboard comprising:

forming a first layer of honeycomb core into the shape of a deck of a surfboard;

covering a top and a bottom of said first layer of honeycomb core with an upper and a lower uncured resin and fiber composite sheet, said upper and lower fiberglass sheets extending past an outer peripheral edge of said first layer of honeycomb core to form a deck laminate with an outer peripheral deck flap;

placing said deck laminate on a shaped, concave deck mold and surrounding said concave deck mold with a vacuum bag;

drawing a vacuum on said vacuum bag and heating the deck mold to cause said deck laminate to cure to form a cured deck piece;

forming a second layer of honeycomb core into the shape of a bottom of a surfboard;

covering a top and a bottom of said second layer of honeycomb core with an upper and a lower uncured resin and fiber composite sheet, said upper and lower fiberglass sheets extending past an outer peripheral edge of said second layer of honeycomb core to form a bottom laminate with an outer peripheral bottom flap;

placing said bottom laminate on a shaped, concave bottom mold and surrounding said concave bottom mold with a vacuum bag;

drawing a vacuum on said vacuum bag and heating the bottom mold to cause said bottom laminate to cure to form a cured bottom piece;

removing said vacuum bags;

adhering a stringer to an inner surface of one of said cured deck piece and said cured bottom piece parallel to a longitudinal axis of said one of said cured deck piece and said cured bottom piece;

placing an adhesive composition in a contact area where said stringer will be adhered to the other of said cured deck piece and said cured bottom piece; and joining said cured deck piece to said cured bottom piece and said stringer to said other of said cured deck piece and said cured bottom piece said joining step being accomplished by adhering said outer peripheral deck flap to said outer peripheral bottom flap to form a hollow surfboard enclosing an elongated stringer secured within said hollow surfboard.

18. The process of claim 17 wherein said adhering step adheres said stringer to said inner surface of said deck piece.

19. The process of claim 17 wherein said placing an adhesive composition step includes depositing a layer of polyurethane prefoam at said contact area immediately before said joining step.

* * * * *